US007006646B1

(12) United States Patent
Baechler

(10) Patent No.: US 7,006,646 B1
(45) Date of Patent: Feb. 28, 2006

(54) DEVICE FOR ADAPTING AT LEAST ONE ACOUSTIC HEARING AID

(75) Inventor: Herbert Baechler, Meilen (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/605,039

(22) Filed: Jun. 27, 2000

Related U.S. Application Data

(63) Continuation of application No. PCT/CH99/00355, filed on Jul. 29, 1999.

(51) Int. Cl.
*H04R 25/00* (2006.01)

(52) U.S. Cl. ..... 381/314; 381/312; 381/60

(58) Field of Classification Search ..... 381/60, 381/312, 314, 315–316, 323, 23.1; 73/585; 600/559; 607/55, 56, 57
See application file for complete search history.

(56) References Cited

U.S. PATENT DOCUMENTS

| | | | | |
|---|---|---|---|---|
| 4,548,082 A | | 10/1985 | Engerbretson et al. | |
| 4,759,070 A | | 7/1988 | Voroba et al. | |
| 4,989,251 A | * | 1/1991 | Mangold | 381/60 |
| 5,226,086 A | * | 7/1993 | Platt | 381/60 |
| 5,910,997 A | * | 6/1999 | Ishige et al. | 381/314 |
| 6,058,197 A | * | 5/2000 | Delage | 381/314 |
| 6,240,194 B1 | * | 5/2001 | De Koning | 381/315 |
| 6,286,073 B1 | * | 9/2001 | Vegter | 710/129 |
| 6,556,686 B1 | * | 4/2003 | Weidner | 381/312 |

FOREIGN PATENT DOCUMENTS

| | | |
|---|---|---|
| EP | 0 537 026 A2 | 4/1993 |
| EP | 0 661 905 A2 | 7/1995 |

OTHER PUBLICATIONS

WO 99/13699, Digital Communication Method and Digital Communication System, Mar. 25, 1999.

* cited by examiner

*Primary Examiner*—Suhan Ni
(74) *Attorney, Agent, or Firm*—Pearne & Gordon LLP

(57) ABSTRACT

The invention relates to fitting apparatus for hearing aids, wherein a first interface transmitting a signal to a hearing aid (7) and a second interface receiving individual response signals to auditory stimulus (9) are merged into a single interface (13).

19 Claims, 2 Drawing Sheets

-- PRIOR ART --

DEVICE FOR ADAPTING AT LEAST ONE ACOUSTIC HEARING AID

This is a continuation of PCT/CH99/00355, filed Jul. 29, 1999.

BACKGROUND OF THE INVENTION

The present invention relates to a device, hereafter apparatus, to adapt, hereafter fit, a hearing aid to the auditory needs of an individual with said hearing device applied.

Increasing the hearing-aid industry processes the audio signals digitally. At the near end of a process, a digital signal-processing unit transmits audio signals to an electrical/mechanical coupler of a hearing aid. The transfer function of the hearing aid between the acoustic/electric input transducer and the electric/mechanical output transducer is set up in such manner at the signal processing unit that the hearing aid shall extensively eliminate idiosyncratic hearing deficiencies.

It is probably obvious that such hearing aids can be optimally useful if—usually stepwise—first a coarse fitting is carried out and then, in situ, a fine one during which the hearing-aid transfer parameters are matched to idiosyncratic needs.

Typically coarse fitting is based on diagnostic data such as audiograms. At least part of the transfer parameters are fitted on the basis of such data in the hearing aid, or else the kind of hearing aid is selected first accordingly.

Then fine fitting is carried out in situ. Basically an individual to receive one or two hearing aids shall wear it (them) to be exposed to test auditory signals. Said individual is asked to report his responses to the test signals and fine fitting of parameters is then carried out accordingly.

It also follows clearly that manually fine-fitting the transfer parameters at the hearing aids while at the individual's ear is an impractical procedure if carried out manually, for instance by operating a potentiometer. Accordingly such hearing aids are equipped with an appropriate interface, namely a communication link to a fitting calculator, primarily to the communication system "computer to hearing aid".

In the simplest case, which however is not operatively the optimal one, the individual verbally informs an expert, such as a hearing-aid acoustician, of his rating of the audio test signal. The acoustician, following appropriate conversion, feeds data into an input device, usually a keypad, to the fitting calculator. This calculator determines/computes setpoints of electronic units of the hearing aid, said setpoints being transmitted by said communication link from the fitting calculator to the hearing aid.

Such operations, being based on verbal communication of the individual's response to audio test signals and the conversion into quantified inputs to the fitting calculator, require unusually well trained technical personnel.

To eliminate this problem and to design the in-situ fitting procedure to be as short and as rational as possible regarding the said individual, individual responses already have been standardized and hence no longer are transferred through the hearing-aid specialist to the fitting calculator, but instead are transmitted directly. For that purpose input units with simple key functions are used, which allow the individual to rate the perceived audio test signals for instance on a given scale. This input unit communicates directly with the fitting calculator.

In increasing manner, digital hearing aids are being fitted according to perceived psycho-acoustic values, namely loudness. Reference is made in this regard to the European patent document 0 661 906 A which corresponds to the U.S. application Ser. No. 08/720,748 by this applicant. Illustratively these documents elucidate how the psycho-acoustic perceived value (loudness) can be rated according to a scale by an individual and how a calculator unit sets the hearing-aid transfer parameters caused by the response to stimulus for the specific, critical frequency bands of human hearing. This procedure is comprehensively discussed in the cited document and affects the present invention only in that it explains for instance how a fitting calculator determines transfer-function parameters based on the individual's rated statements of loudness.

BRIEF SUMMARY OF THE INVENTION

Provided is an apparatus for fitting at least one hearing aid to the needs of an individual, comprising a fitting calculator with a first interface to transmit signals to a hooked-up hearing aid, with a second interface to receive response signals to auditory stimuli, and a computer unit that, as a function of inputs to the second interface, computes outputs to the first interface, characterized in that the first and second interfaces are merged into a single interface which is configured as a bidirectional communication unit. Preferably, the interfaces are of the $I^2C$ type, the apparatus includes a rating input unit in the form of a keypad or voice input device for inputting auditory-stimulus response signals.

DETAILED DESCRIPTION OF THE PREFERRED EMBODIMENTS

Figure 1:
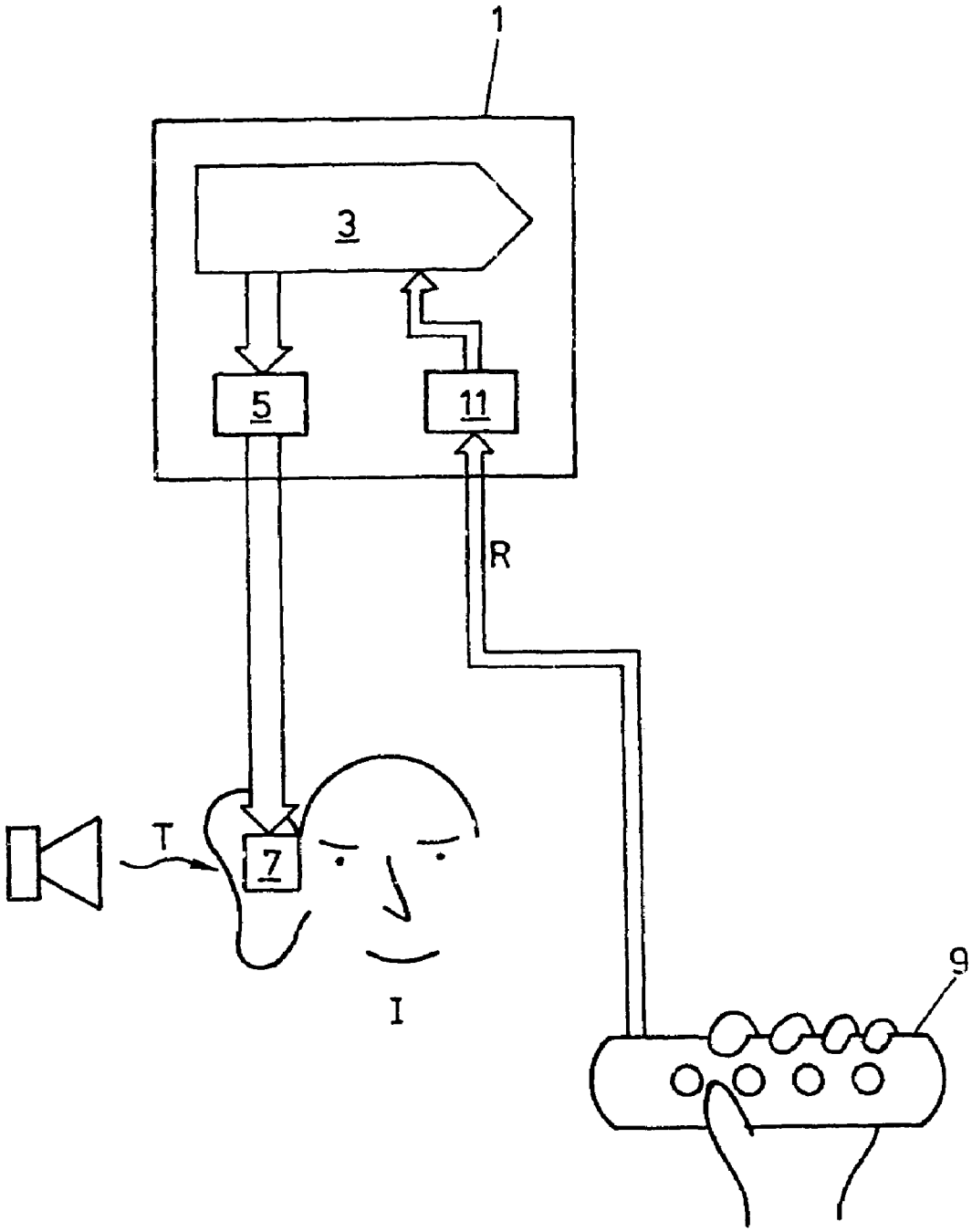
FIG. 1 represents a presently known geometry of an apparatus for programming a hearing aid.

FIG. 1 shows the presently known geometry of an apparatus for the in-situ fitting of one hearing aid, or, in the case of binaural fitting, of two. This apparatus on one hand comprises a fitting calculator unit 1 with a digital computer 3. The setpoints determined by the digital processing unit 3 are transferred through an interface 5 to the hearing aid 7 borne by the individual 1, wherein they result in fine fitting the relevant transfer parameters. As indicated in schematic manner, the Individual I is subjected to acoustic test signals T and responds by grading the perceived stimulus on a rating unit 9. The grading result is transmitted to an interface 11 at the fitting calculator 1. The fine parameter matching is calculated by the computer unit 3 from these rating signals R and from the typically pre-known fitting history.

The present invention relates to the communications link between the fitting calculator 1 and the hearing 7 and the rating unit 9. The purpose of the present invention, as indicated schematically in FIG. 1, is to substantially simplify said apparatus. Accordingly this apparatus is characterized by the features of a first aspect of the invention. Therein the first interface comprises a signal output to at least one hooked-up hearing aid and the surface interface is combined with the first to receive individual response signals to audio stimuli.

Because critical safety requirements are placed on electromedical interfaces transmitting electrical signals in situ to pertinent equipment, such interfaces are expensive, for instance including electric signal isolation. In this respect the rating unit 9, through less critical than the ear, also must be considered problematic, and therefore the design of the invention, namely to combine the two interfaces, which is comparatively expensive for these electro-medical safety requirements, offers the substantial advantage that both implements, namely the hearing aid and the rating unit, are optimally made safe.

The interface of the invention is bidirectional, that is, it must transmit signals from the computer unit as well as feed signals to it.

In a preferred embodiment of the invention, its interface unit is an $I^2C$ unit and the communications links, on one hand to at least one hearing aid and on the other hand to the rating unit is a two-line $I^2C$ bus. This two-wire control bus technology is well known and at the present time is sold by Phillips Co.

However and illustratively, the communications link can be implemented by means of $I^2S$ interfaces also sold by Phillips Co, in particular if expanded for two-way communications in the manner comprehensively discussed by the present applicant in its application WO99/13699.

According to a second aspect, when the apparatus is operational, it comprises a rating unit for auditory-stimulation response signals, preferably in the form of a keypad, of a voice input, the rating input being connectable to the interface.

Even though the interface unit of the invention may be physically configured inside the fitting calculator and comprises one physical connection each for the minimum of one hearing aid and to the rating input unit, a preferred embodiment of the interface unit of the invention is in the form of a branching unit comprising at least one connection to the fitting calculator one connection to a rating input unit and one connection to the minimum of one hearing aid.

The communication between the single interface unit and the hearing aid or the rating input unit shall be wired or wireless, where, in the latter case, the hearing aid shall include a receiver stage, the rating input unit shall include at least one transmitter and, appropriately, the transmitter and receiver shall be configured at the interface.

The invention is next elucidated in relation to another Figure which, based on FIG. 1, shows one embodiment of the apparatus of the invention.

Components already discussed in relation to FIG. 1 shall be identically referenced in the second Figure.

The invention provides a single interface 13 for the hookup both to the rating input unit 9 and the hearing aid 7, said interface 13 communicating in both directions with the computer unit 3 in the fitting calculator 1 and either releasing the rating input unit 9, to feed data into the computer unit 3, or the computer unit 3, to feed data into the hearing aid.

Figure 2:
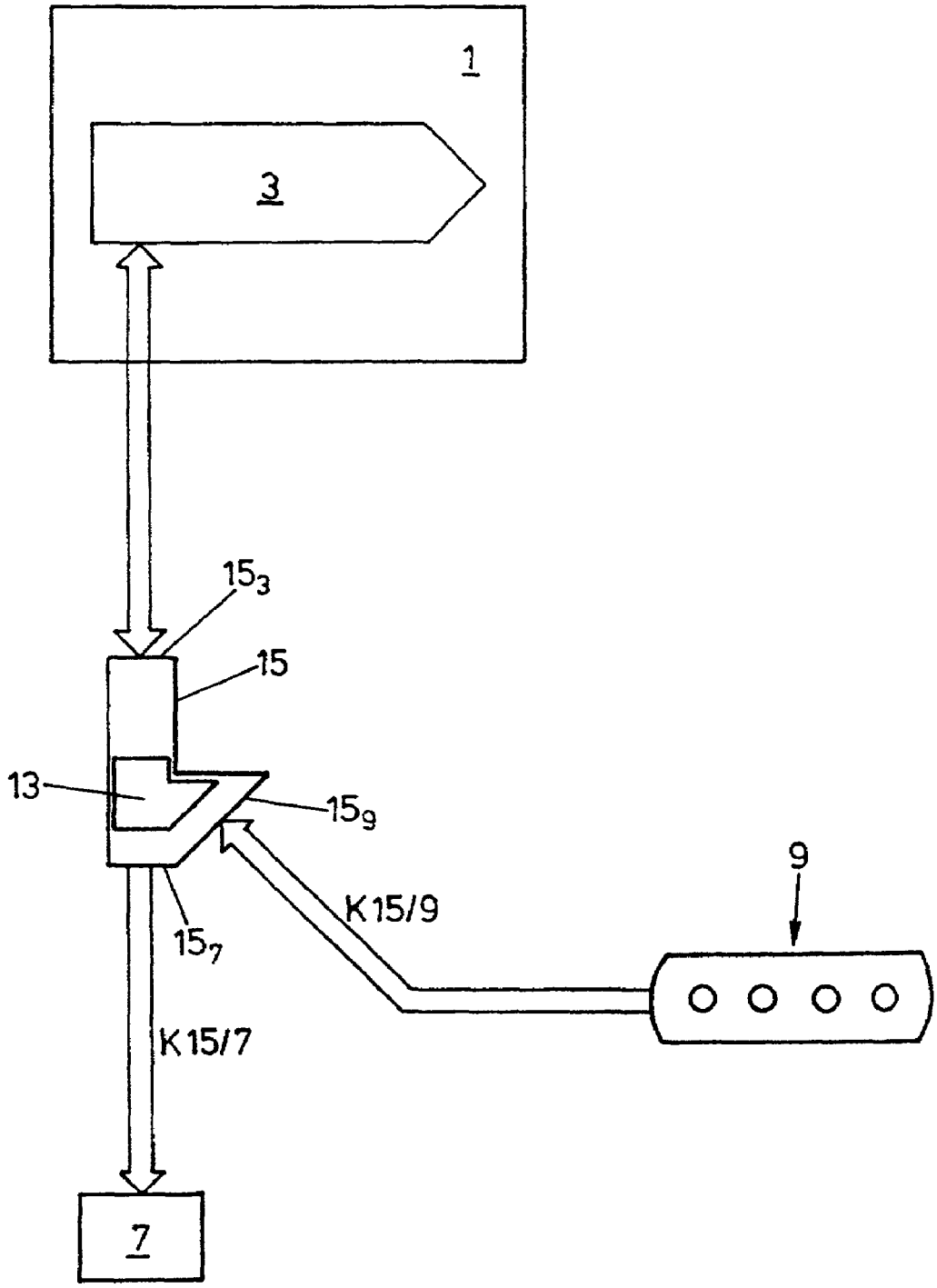
FIG. 2 represents one embodiment of the invention utilizing a combined interface.

In a manner evident to the expert, FIG. 2 shows that the interface 13 of the invention in principle can be configured arbitrarily close to the computer unit 3; nevertheless and as shown by FIG. 2, the preferred embodiment is designed as a branching unit 15. Said unit 15 communicates through a first connector $\mathbf{15}_3$ with the computer unit 3, through a second connector $\mathbf{15}_9$ with the rating input unit 9, and through a third connector $\mathbf{15}_7$ with the hearing aid 7. In a further preferred embodiment of the invention, the communication between the interface 13 and the rating input unit 9 as well as between the interface 13 and the hearing aids $K_{15/9}$ or $K_{15/7}$ is implemented, as shown in FIG. 2, by $I^2C$ buses, the interface 13 being designed as an $I^2C$ interface at least with respect to said components 7 and 9. Corresponding $I^2C$ interfaces are present at the components 9 and 7.

It is understood that all the cited communications links K, including those between the interface 13 and the computer unit 3, may be wireless, whether individually or in combination, with omitted transceivers mounted on the components 1, 15, 9 or 7. The computer unit 3 drives the interface 13 to generate, in time-sequential manner, communications between the rating input 9 and the computer unit 3 or between the computer unit 3 and the hearing aid 7.

What is claimed is:

1. A fitting system for in situ fitting at least one hearing device to the auditory needs of an individual with said hearing device applied comprising:

a fitting calculator unit with an input and with a setting signal output being linkable to a setting input of a hearing device applied to said individual; and a rating unit with an output and generating at said output an output signal as a response of said individual's appraisal of an auditory stimulus;

a bidirectional interface unit having an input linked to the output of the rating unit, an output being linkable to the setting input of the hearing device, and an input/output being linkable to both the input and the setting signal output of the fitting calculator unit;

said bidirectional interface unit exclusively providing for transfer of information contained in a signal at the output of the rating unit to the input of the fitting calculator;

said bidirectional interface unit exclusively providing for transfer of information contained in a setting signal at the setting signal output of the fitting calculator unit to the setting input of the hearing device;

said fitting calculator generating setting signals for said hearing device as a function of said output signal of said rating unit.

2. The fitting system of claim 1, wherein said bidirectional interface is an I2C interface.

3. The fitting system of claim 1, wherein said rating unit is at least one of a keypad and of a voice input device.

4. The fitting system of claim 1, wherein said bidirectional interface unit is a standalone unit and comprises an output/input for signals to and from said input and said setting output of said fitting calculator unit and an output linkable to said setting input of said hearing device and an input linked to said output of said rating unit.

5. The fitting system of claim 1, wherein at least one of a link between said setting signal output of said calculator unit and said setting input of a hearing device and of a link between said output of said rating unit and said input of said fitting calculator unit comprises a wireless link.

6. The fitting system according to claim 1 wherein the bidirectional interface is remote from the fitting calculator.

7. A method for fitting at least one hearing device comprising:

applying to an individual a hearing device with a setting input;

exposing said individual with said hearing device to an auditory stimulus;

having said individual input his appraisal of said auditory stimulus to a rating unit;

communicating a signal in dependency of said appraisal to a fitting calculator unit;

calculating setting values by said fitting calculator unit in dependency of said appraisal signals;

communicating from said fitting calculator unit said setting signal to a setting input of said hearing device at said individual, thereby performing communication of said appraisal signals to said fitting calculator unit and of said setting values to said hearing device exclusively via a bidirectional interface.

8. A fitting system for in situ fitting at least one hearing device to the auditory needs of an individual with said hearing device applied comprising:

a fitting calculator unit with an input and with a setting signal output being linkable to a setting input of a hearing device applied to said individual; and a rating unit with an output and generating at said output an output signal as a response to said individual's appraisal of an auditory stimulus;

wherein said output of said rating unit is linked to said input of said fitting calculator unit and said setting signal output of said calculator unit is linkable to said setting input of said hearing device at said individual exclusively via a bidirectional interface unit remote from said fitting calculator; and said fitting calculator generates setting signals for said hearing device as a function of said output signal of said rating unit.

9. The fitting system of claim 8, wherein said bidirectional interface is an I2C interface.

10. The fitting system of claim 8, said rating unit including at least one of a keypad and a voice input device.

11. The fitting system of claim 8, wherein said bidirectional interface unit is a standalone unit and comprises an interface for signals to and from said input and said setting output of said fitting calculator unit and an output linkable to said setting input of said hearing device and an input linked to said output of said rating unit.

12. The fitting system of claim 8, wherein at least one of a link between said setting signal output of said calculator unit and said setting input of a hearing device, and of a link between said output of said rating unit and said input of said fitting calculator unit comprises a wireless link.

13. A method for fitting at least one hearing device comprising:

applying to an individual a hearing device with a setting input;

exposing said individual with said hearing device to an auditory stimulus;

having said individual input his appraisal of said auditory stimulus to a rating unit;

communicating a signal in dependency of said appraisal to a fitting calculator unit;

calculating setting values by said fitting calculator unit in dependency of said appraisal signals;

communicating from said fitting calculator unit said setting signal to a setting input of said hearing device at said individual, thereby performing communication of said appraisal signals to said fitting calculator unit and of said setting values to said hearing device exclusively via a bidirectional interface remote from said fitting calculator.

14. A system for adapting at least one hearing device to the needs of an individual, comprising:

an adaptation computing unit (1);

a first interface unit for exclusive output of signals to at least one hearing device (7) connectable thereto;

a second interface unit for exclusive acceptance of individual audio-stimulant reaction signals;

a computing unit (3) of the adaption computing unit for calculating signals to be output by the first interface unit, the signals being calculated based on audio-stimulant reaction signals accepted by the second interface unit;

wherein the first and second interface units are in the form of a single bidirectional communication unit.

15. The system according to claim 14, wherein the bidirectional communication unit (13) is an I2C interface unit.

16. The system according to claim 14, further comprising an assessment input unit (9) is provided for audio-stimulant reaction signals, the assessment unit being at least one of a keypad and a voice input unit, the assessment input unit being connectable to the bidirectional communication unit (13).

17. The system according to claim 14, wherein the bidirectional communication unit is formed as a branching unit with a connection to the adaptation computing unit, a connection to an assessment input unit and a connection to the at least one hearing device.

18. The system according to claim 14, wherein a communication connection between the hearing device and/or an input unit and the adaptation computing unit (1) is at least partly wireless.

19. A fitting system for in situ fitting at least one hearing device to the auditory needs of an individual with said hearing device applied comprising a fitting calculator unit with an input and with a setting signal output being linkable to a setting input of a hearing device applied to said individual; and a rating unit with an output and generating at said output an output signal as a response of said individual's appraisal of an auditory stimulus;

said output of said rating unit being directly linked to said input of said fitting calculator unit and said setting signal output of said calculator unit being directly linkable to said setting input of said hearing device at said individual via a bidirectional interface unit;

said fitting calculator generating setting signals for said hearing device as a function of said output signal of said rating unit.

* * * * *